US009455523B1

(12) United States Patent
Sundarakrishnamachari et al.

(10) Patent No.: US 9,455,523 B1
(45) Date of Patent: Sep. 27, 2016

(54) RIGHT ANGLE CONNECTION ASSEMBLY

(71) Applicant: Delphi Technologies, Inc., Troy, MI (US)

(72) Inventors: Rangarajan Sundarakrishnamachari, Chennai (IN); Anthony Raschilla, Girard, OH (US); Shanmuga Sundaram Ramasamy, Tiruppur (IN)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/818,429

(22) Filed: Aug. 5, 2015

(51) Int. Cl.
*H01R 13/502* (2006.01)
*H01R 13/52* (2006.01)

(52) U.S. Cl.
CPC ..... *H01R 13/5202* (2013.01); *H01R 13/502* (2013.01)

(58) Field of Classification Search
CPC ..... H01R 13/6397; H01R 13/62933; H01R 13/639; H01R 13/6272; H01R 13/506; H01R 23/02; H01R 13/502; H01R 13/113; H01R 13/11; H01R 4/183; H01R 13/04
USPC ..... 439/304, 310, 347, 352, 686, 689, 690, 439/693, 854, 855, 881, 891
See application file for complete search history.

(56) References Cited

U.S. PATENT DOCUMENTS 5,174,785 A * 12/1992 Endo ..... H01R 12/724 439/157
5,320,556 A * 6/1994 Otaka ..... H01R 13/641 439/372
5,425,653 A * 6/1995 Koiso ..... H01R 13/641 439/347
5,681,184 A * 10/1997 Pamart ..... H01R 13/4362 439/310
5,775,957 A * 7/1998 Fink ..... H01R 13/4361 439/595
6,210,186 B1 * 4/2001 Fink ..... H01R 13/62927 439/157
6,254,407 B1 * 7/2001 Burns ..... H01R 13/62905 439/157
6,491,542 B1 * 12/2002 Zerebilov ..... H01R 13/4226 439/352
6,537,099 B2 * 3/2003 Herlinger ..... H01R 13/6397 439/352
7,241,183 B2 * 7/2007 Wasalaski ..... H01R 13/447 439/686
7,351,089 B2 * 4/2008 Neale, III ..... H01R 13/6277 439/352
7,494,352 B2 * 2/2009 Furio ..... H01R 13/62955 439/157
7,632,116 B2 * 12/2009 Lee ..... H01R 13/635 439/157

(Continued)

FOREIGN PATENT DOCUMENTS

WO 2014114324 A1 7/2014

*Primary Examiner* — Thanh Tam Le
(74) *Attorney, Agent, or Firm* — Robert J. Myers

(57) ABSTRACT

A right angle connector assembly including a first connector having a mating assist slider configured to slide along a first axis defined by the first connector and a second connector having a second housing and an intermediate housing attached to the second housing that is configured to slide along a second axis defined by the second connector that is substantially perpendicular to the first axis. The intermediate housing is configured to receive the first connector along the first axis. When the mating assist slider is moved along the first axis from a starting position to and ending position, the mating assist slider moves intermediate housing along the second axis from an initial position to a final position, thereby mating a first terminal within the first connector to a second terminal within the second connector at a right angle or ninety degree orientation.

11 Claims, 10 Drawing Sheets

(56) References Cited

U.S. PATENT DOCUMENTS 7,918,675 B2 * 4/2011 Van Den Meersschaut .... H01R 13/62911 439/157
8,016,602 B2 * 9/2011 Wadoux ..... H01R 13/62933 439/157
8,597,062 B2 * 12/2013 Casses ..... H01R 4/184 439/686
8,651,883 B2 * 2/2014 Becavin ..... H01R 13/6395 439/157
8,956,192 B2 * 2/2015 Eckel ..... H01R 13/44 439/686
8,968,021 B1 * 3/2015 Kennedy ..... H01R 13/6273 439/352
9,059,540 B2 * 6/2015 Menez ..... H01R 13/6272
9,209,582 B2 * 12/2015 Kashiwada ..... H01R 13/6315
9,257,772 B2 * 2/2016 Natter ..... H01R 13/42
2014/0106591 A1 4/2014 Menez et al.

* cited by examiner

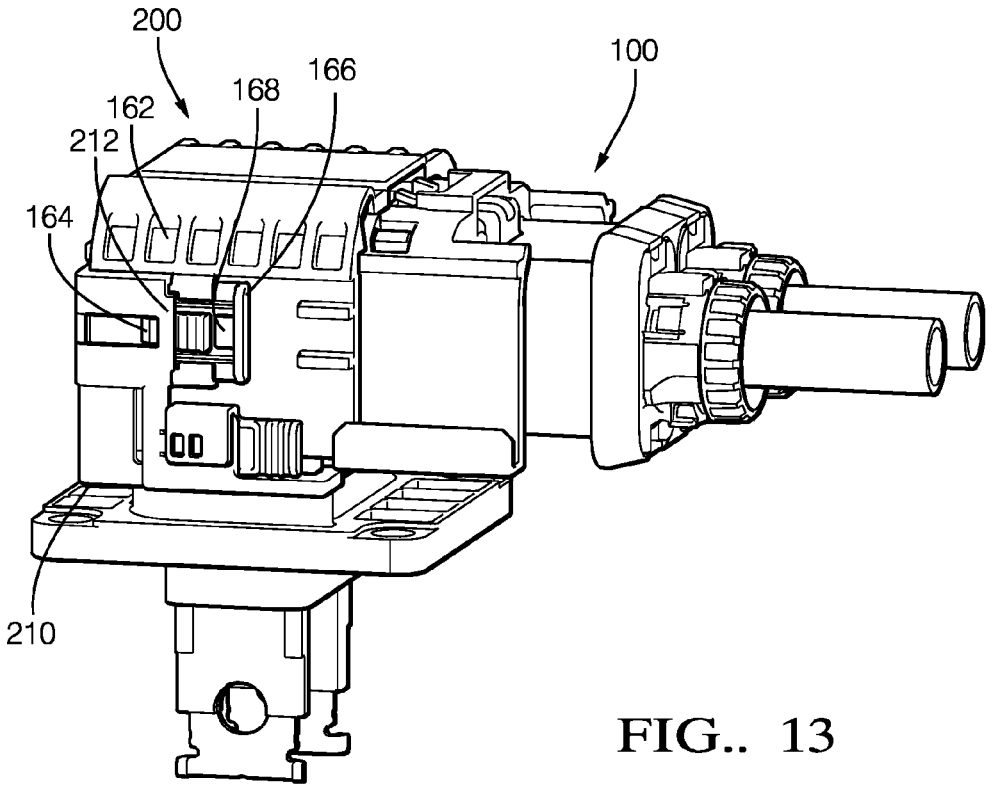
FIG.. 13
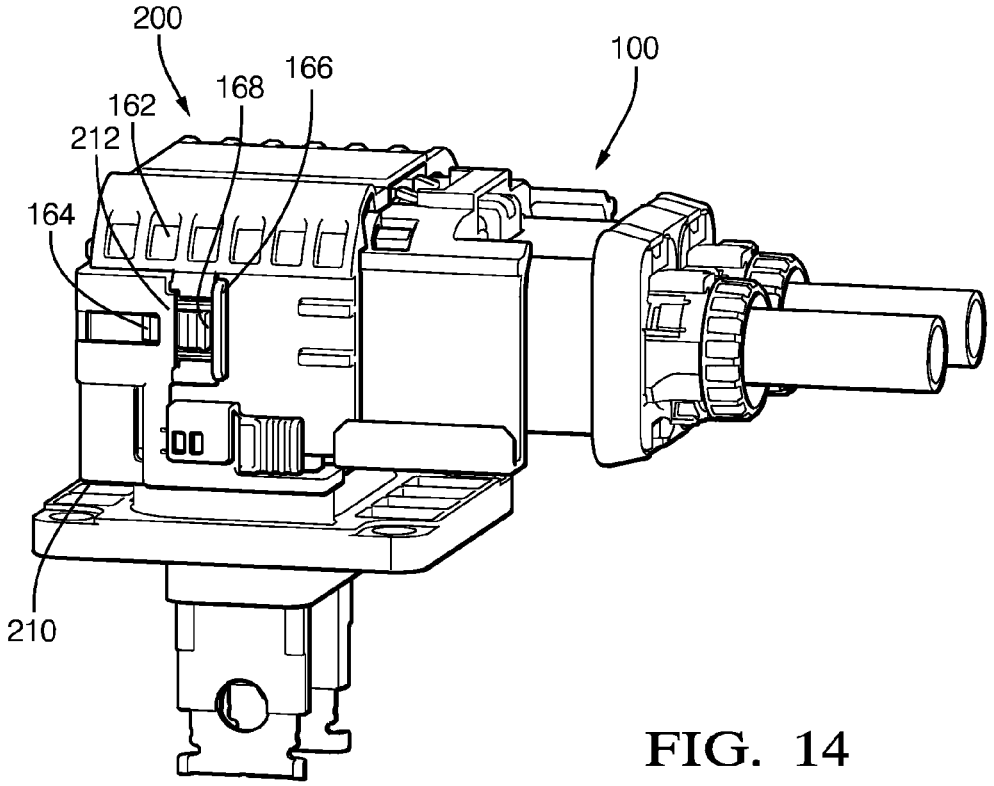
FIG. 14

RIGHT ANGLE CONNECTION ASSEMBLY

TECHNICAL FIELD OF THE INVENTION

The invention relates to a connection assembly, particularly a connector designed to connect electrical conductors in a right angle or ninety degree configuration.

BACKGROUND OF THE INVENTION

Right angle electrical connectors are desirable in certain applications to minimize packaging space needed for connecting electrical conductors, especially compared to straight line connectors. This may be crucial for meeting packaging space requirements in electrical or hybrid electrical vehicles. Electrical connection assemblies having a high connection force typically require a mating assist device to meet ergonomic requires for assembly operators. For packaging space requirements, the space required around the connector must also be considered, so it is desirable to avoid connector systems that require additional space for an operator's hand to make the connection, e.g. lever based mating assist connectors.

When connectors are used in high voltage application, e.g. greater than 48 volts, it is desirable to prevent accidental contact with energized terminals. Prior art solutions have used interlock circuits that prevent terminals from being energized until after the interlock circuit is completed by the proper mating of the connector assembly. However, additional protective measures may be desired to prevent accidental contact with the energized terminals to provide a fail-safe system.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with a first embodiment of the invention, an electrical connector assembly is provided. The electrical connector assembly includes a first connector having a first housing containing a first electrical terminal and a mating assist slider that is attached to the first housing. The mating assist slider is configured to slide along a first axis defined by the first connector. The electrical connector assembly includes a second connector having a second housing containing a second electrical terminal and an intermediate housing attached to the second housing. The intermediate housing is configured to slide along a second axis defined by the second connector. The intermediate housing is configured to receive the first housing along the first axis. The mating assist slider is configured to move the intermediate housing along the second axis from an initial position to a final position when the mating assist slider is moved along the first axis from a starting position to and ending position, thereby mating the first electrical terminal to the second electrical terminal. The first axis is substantially perpendicular to the second axis.

In accordance with a second embodiment of the invention, the electrical connector assembly further includes a terminal cover that is attached to the intermediate housing.

The terminal cover is configured to enclose the second electrical terminal when the intermediate housing is in the initial position and at least partially expose the second electrical terminal when the intermediate housing is in the final position.

In accordance with a third embodiment of the invention, the electrical connector assembly further comprises a locking bar that is retained and slideably attached to the intermediate housing. The second housing defines a locking groove in which the locking bar may be engaged. The locking bar is configured to secure the intermediate housing in the initial position to the final position when the locking bar is engaged with the locking groove and allow movement of the intermediate housing from the initial position to the final position when the locking bar is disengaged from the locking groove.

In accordance with a fourth embodiment of the invention, the second housing defines a cam post. A least one of two side walls of the mating assist slider defines a cam slot that is configured to receive the cam post of the second connector. Upon moving the mating assist slider from the starting position to the ending position, the cam slot is moved relative to the cam post producing a force along the second axis which drives the intermediate housing from the initial position to the final position.

In accordance with a fifth embodiment of the invention, the electrical connector assembly further includes a connector position assurance device that is slideably attached to the mating assist slider and is configured to inhibit movement of the mating assist slider from the ending position when engaged.

In accordance with a sixth embodiment of the invention, the electrical connector assembly further contains an intermediate/first housing seal that is configured to provide an environmental seal between the intermediate housing and the first housing when the first housing is mated with the intermediate housing.

In accordance with a seventh embodiment of the invention, the electrical connector assembly further comprises an intermediate seal that is configured to provide an environmental seal between the intermediate housing and the second housing when the intermediate housing is in the final position.

In accordance with a eighth embodiment of the invention, the first connector includes an interlock shunt and the second connector includes a pair of interlock terminals. The interlock shunt is configured to electrically connect the pair of interlock terminals when the intermediate housing is in the final position.

BRIEF DESCRIPTION OF THE SEVERAL VIEWS OF THE DRAWING

The present invention will now be described, by way of example with reference to the accompanying drawings, in which:

FIG. 13 is a side view of the first and second connectors of the electrical connector assembly of FIG. 1 in the fully mated condition of FIG. 11 having a connector position assurance (CPA) device disengaged according to one embodiment; and FIG. 14 is a side view of the first and second connectors of the electrical connector assembly of FIG. 1 in the fully mated condition of FIG. 11 having the CPA device engaged according to one embodiment.

DETAILED DESCRIPTION OF THE INVENTION

Presented herein in a right angle electrical connector assembly. The connector assembly includes a first connector having a first housing that contains at least one female connector terminal terminating a wire cable. A mating assist slider is attached to the first connector. The connector assembly also includes a second connector having a second housing that contains at least one male connector terminal configured to mate with the female terminal and designed to terminate another wire cable. The second connector also has an intermediate housing attached and moveable relative to the second conductor housing. When the first housing is connected with the intermediate housing, the mating assist slider receives a post on the second connector body into a cam slot. As the mating assist slider is moved forward over the intermediate housing, the post and cam slot cooperate to drive the intermediate housing onto the second housing, thereby connecting the female terminals to the male terminals.

Figure 1:
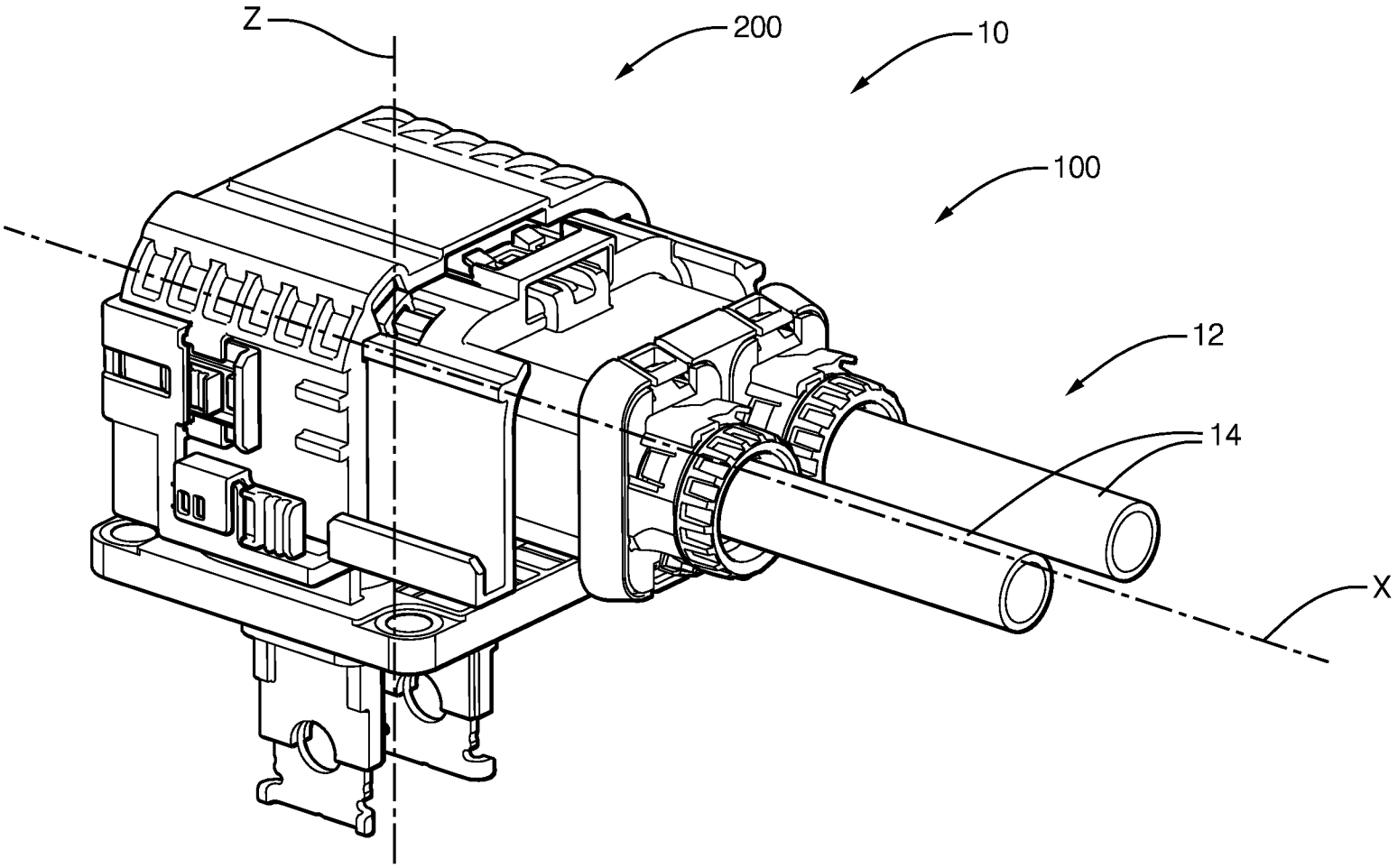
FIG. 1 is a perspective view of an electrical connector assembly according to one embodiment.

FIG. 1 illustrates a non-limiting example of a high voltage right angle connector assembly 10 designed to interconnect a high voltage wiring harness 12 to an electrical device (not shown) contained within a conductive housing, such as a battery pack or a power inverter in an electric or hybrid electric vehicle (not shown). According to this embodiment of the invention, the assembly includes a first connector 100 containing a pair of female terminals 102 that terminate a pair of shielded heavy gauge wire cables of the high voltage wiring harness 12. The assembly also includes a second connector 200 containing a pair of male blade terminals 202. The second connector 200 is designed to be attached to a conductive case (not shown), such as a battery pack case and the male terminals 202 are configured to attached to flexible wire cables or rigid bus bar conductors within the case (not shown).

Figure 2:
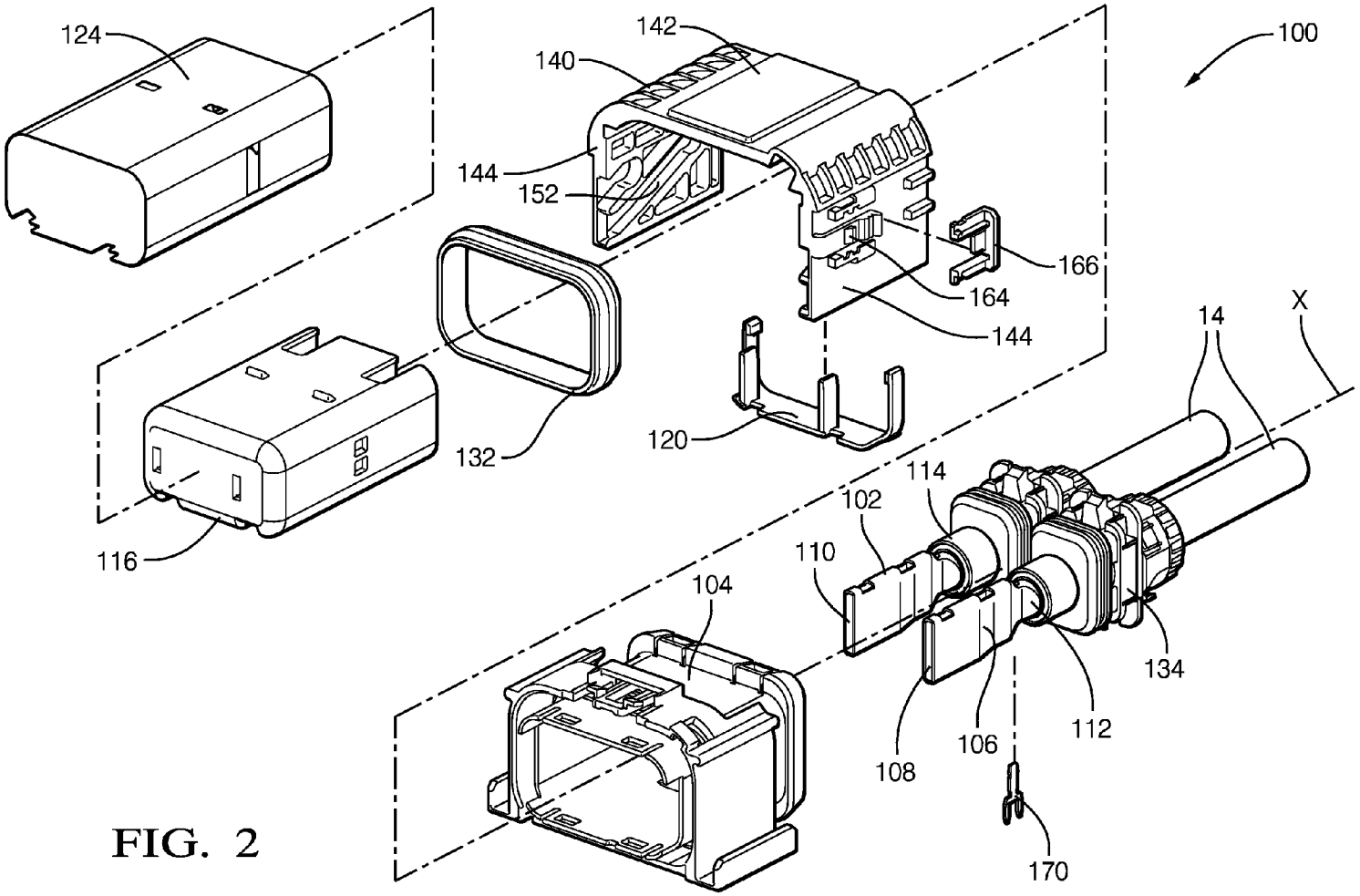
FIG. 2 is an exploded perspective view of a first connector of the electrical connector assembly of FIG. 1 according to one embodiment.

An exploded diagram of the first connector 100 is shown in FIG. 2. The first connector 100 is based around a first housing 104 to which the other components of the first connector 100 are attached. The first housing 104 is formed of a dielectric material such as polybutylene terephthalate (PBT), polypropylene (PP), or polyamide (PA, commonly known as NYLON).

The female terminals 102 are formed of a conductive material, such as a copper-based material. The female terminals 102 have a mating portion 106 that is configured to mate, i.e. form a mechanical and electrical connection, with the male terminals 202. The mating portion 106 is generally U-shaped having a first terminal opening 108 that is generally perpendicular to the first axis X and a second terminal opening 110 that is generally parallel to the first axis X. The first terminal opening 108 allows the female terminal 102 to mate with the male connector in a ninety-degree connection.

The female terminal 102 also has a cable connection portion 112 that is configured to electrically and mechanically connect the female terminal 102 the inner conductor of the shielded wire cable (not shown). The cable connection portion 112 is configured to be sonically welded to the inner conductor of the shielded wire cable. Sonically welding the inner conductor to the female terminal 102 provides the benefit of a lower interface resistance between the inner conductor and the female terminal 102 and provides the benefit of a shorter overall terminal length compared to a terminal configured for a crimp connection to the wire cable. Alternative embodiments of the female terminal configured for crimp connection to a wire cable may be envisioned since a connector assembly with a crimp connection terminal may provide cost savings in applications that allow a larger terminal and/or higher interface resistance.

The outer shield conductor (not shown) of the shielded wire cable is terminated by a pair of conductive ferrules, an inner ferrule (not shown) disposed between the shield conductor (not shown) and an inner insulation layer (not shown) between the shield conductor and the inner conductor and an outer ferrule 114 that is attached over the shield conductor.

Figure 3:
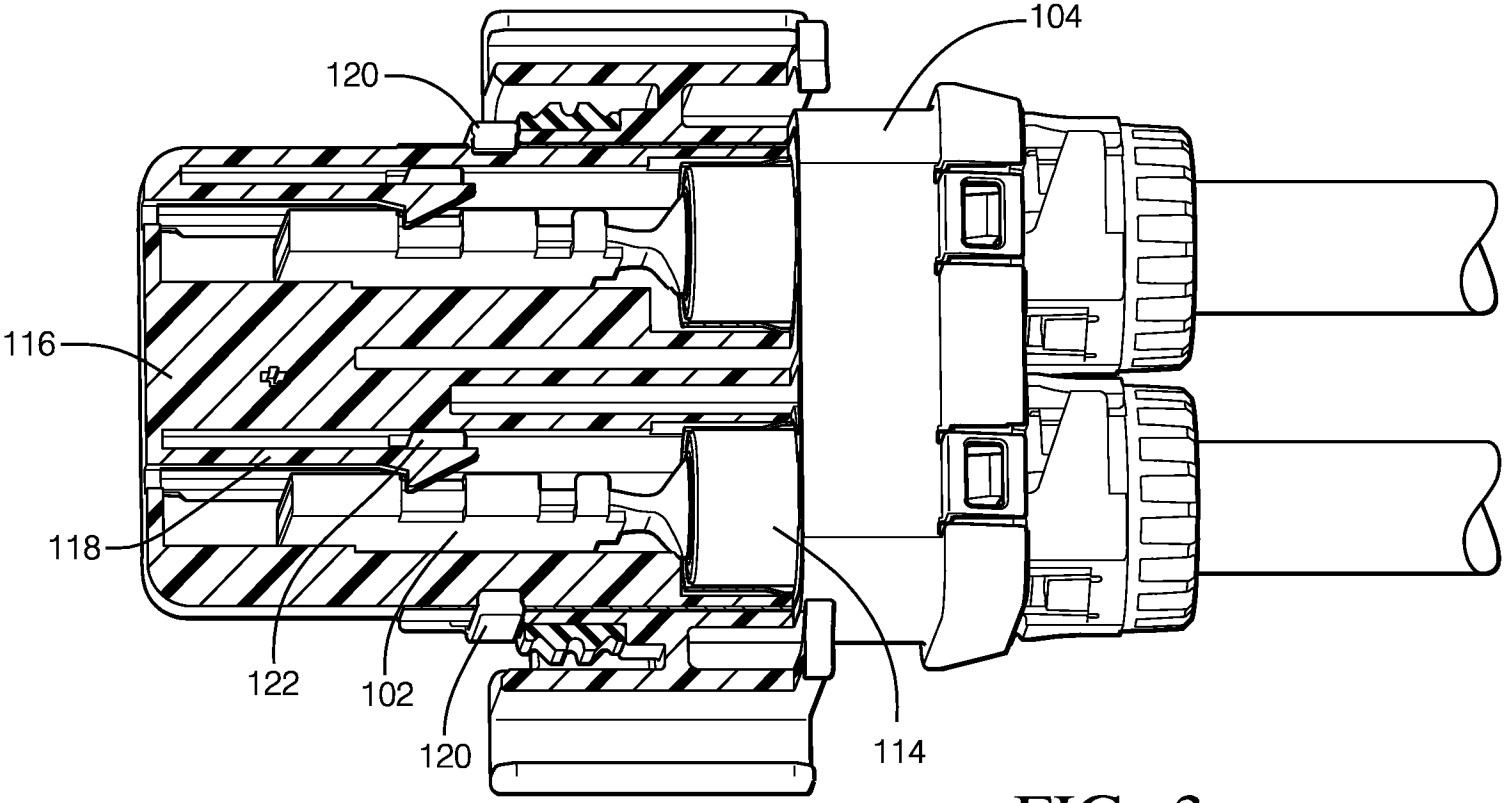
FIG. 3 is a cutaway perspective view of the first connector of FIG. 2 according to one embodiment.

The female terminals 102 are secured within an inner housing 116 also formed of a dielectric material such as PBT, PP, NYLON. Once the female terminals 102 are snapped into place within the inner housing 116 by snap features 118 as shown in FIG. 3, a terminal position assurance (TPA) device 120 attached to the inner housing 116. When the TPA device 120 is moved from pre-staged to a staged position, blades 122 of the TPA device 120 are moved under the snap features 118, inhibiting the snap features 118 from releasing the female terminals 102.

A conductive first grounding shield 124 surrounds a rearward portion of the inner housing 116. The first shield 124 is electrically connected to the outer ferrule 114 by ridges formed in a tubular portion of the first shield 124 configured to receive the outer ferrule 114. The first shield 124 may be formed from a sheet of conductive material, such as plated copper or plated steel, by a deep draw stamping process. Other materials and manufacturing techniques well known to those skilled in the art may also be used to form the first shield 124. The first shield 124 is secured to the inner housing 116 by snap features 126 that engage rectangular holes 128 in the first shield 124, see FIG. 4. The inner housing/first shield/female terminal assembly is secured within the female housing by the same snap features engaging rectangular holes 130 in the female housing, see FIG. 4.

Figure 4:
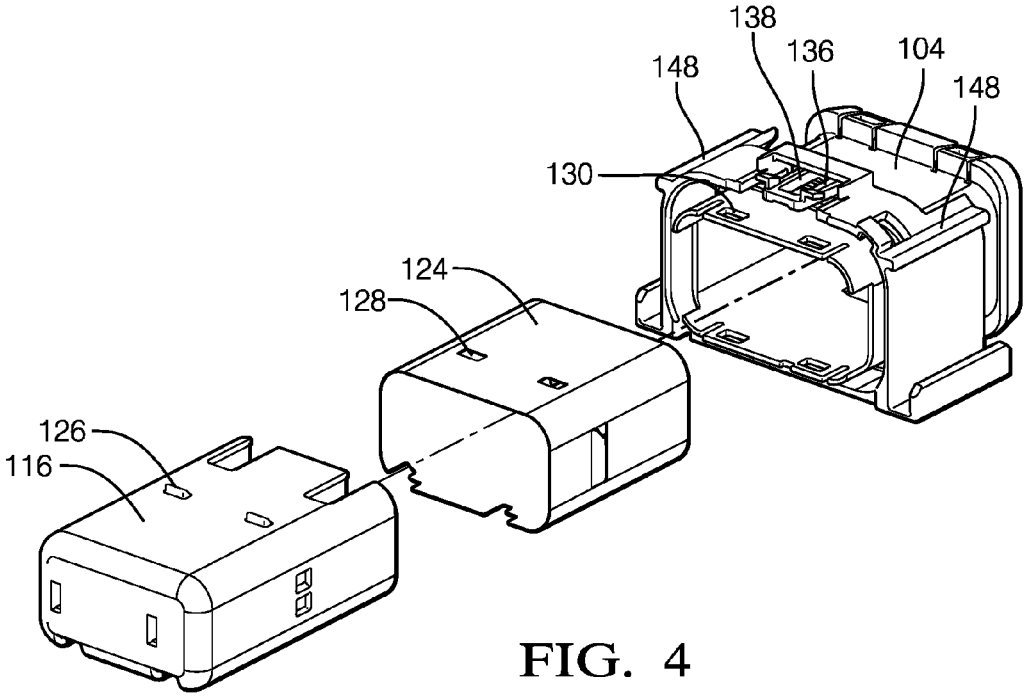
FIG. 4 is an exploded perspective view of a subassembly of the first connector of FIG. 2 according to one embodiment.

The first connector 100 also includes a complaint first seal 132 within the first housing 104 longitudinally surrounding the inner housing 116 as shown in FIG. 4. The first seal 132 is designed to seal the first connector 100 to the second connector 200. The first connector 100 also includes compliant cable seals 134 longitudinally surrounding each of the shielded wire cables 14 and secured to the first connector 100 by cable seal retainers. The first seal 132 and the cable seals 134 may be formed of a compliant material such as silicone rubber. The first seal 132 and the cable seals 134 provide protection for the female terminals 102 from water, dust, and other environmental contaminants.

The first housing 104 defines a flexible primary locking tab 136 having a rectangular slot 138 that is configured to secure the first connector 100 to the second connector 200 by engaging a fixed primary locking nib 204 on the second connector 200.

Figure 5:
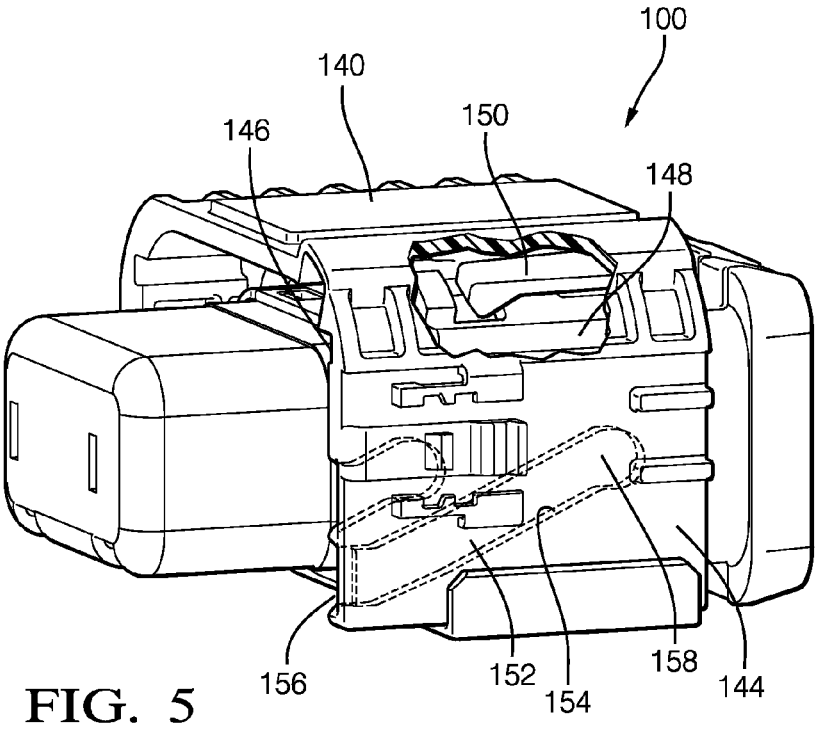
FIG. 5 is an cutaway side view of the first connector of FIG. 2 according to one embodiment.

The first connector 100 further includes a mating assist slider 140 that is slideably connected to the first housing 104. The mating assist slider 140 is formed of a dielectric material such as PBT, PP, or NYLON. The mating assist slider 140 defines a longitudinal channel having a top wall 142 and two side walls 144. Each of the inner side walls 144 defines a groove 146 that receives a rail 148 projecting from each side wall of the first housing 104. The grooves 146 slide longitudinally over the rails 148 along the first axis X. As shown in FIG. 5, a slider latch 150 holds the mating assist slider 140 in a starting position 160 until the slider latch 150 is released when the first connector 100 is mated to the second connector 200. The inner side walls 144 of the mating assist slider 140 also define cam slots 152. The cam slots 152 receive cam posts 206 defined by the second connector 200 when the first connector 100 is initially connected to the second connector 200.

The cam slot 152 defines a ramp 154 between a slot opening 156 and a slot end 158. The ramp 154 is configured to engage the cam post 206 of the second connector 200 in a manner effective to urge the second connector 200 from the initial position 208 to a final position 210 when the mating assist slider 140 is moved from the starting position 160 to an ending position 162.

A ramp angle may be varied along a length of the ramp 154 to reduce a peak value of an applied force F to advance the mating assist slider 140 from the starting position 160 to the ending position 162. The ramp angle may be varied in accordance with an engagement force generated by the first connector 100 and the second connector 200 when they are urged together.

The mating assist slider 140 also includes a secondary locking nib 164 defined by a flexible beam that is configured to engage a fixed secondary locking tab 212 on the second connector 200.

The mating assist slider 140 additionally includes a connector position assurance (CPA) device 166 slideably attached to the mating assist slider 140. A tongue 168 of the CPA device 166 is configured to slide under the secondary locking tab 212 when first and second connectors 100, 200 are mated, thus inhibiting release of the secondary locking nib 164 from the secondary locking tab 212 and preventing the mating assist slider 140 from inadvertently being moved and accidentally unmating the first and second connectors 100, 200.

The first conductor also includes a high voltage interlock (HVIL) shunt 170 that is designed to connect a pair of mating HVIL terminals 214 in the second connector 200 when the first and second connectors 100, 200 are fully mated. The HVIL terminals 214 are linked to a control circuit (not shown) that inhibits the male terminals 202 in the second connector 200 from being energized until the HVIL terminals 214 are shorted by the HVIL shunt 170, ensuring that the female and male terminals 102, 202 are properly connected before energizing the male terminals 202.

Figure 6:
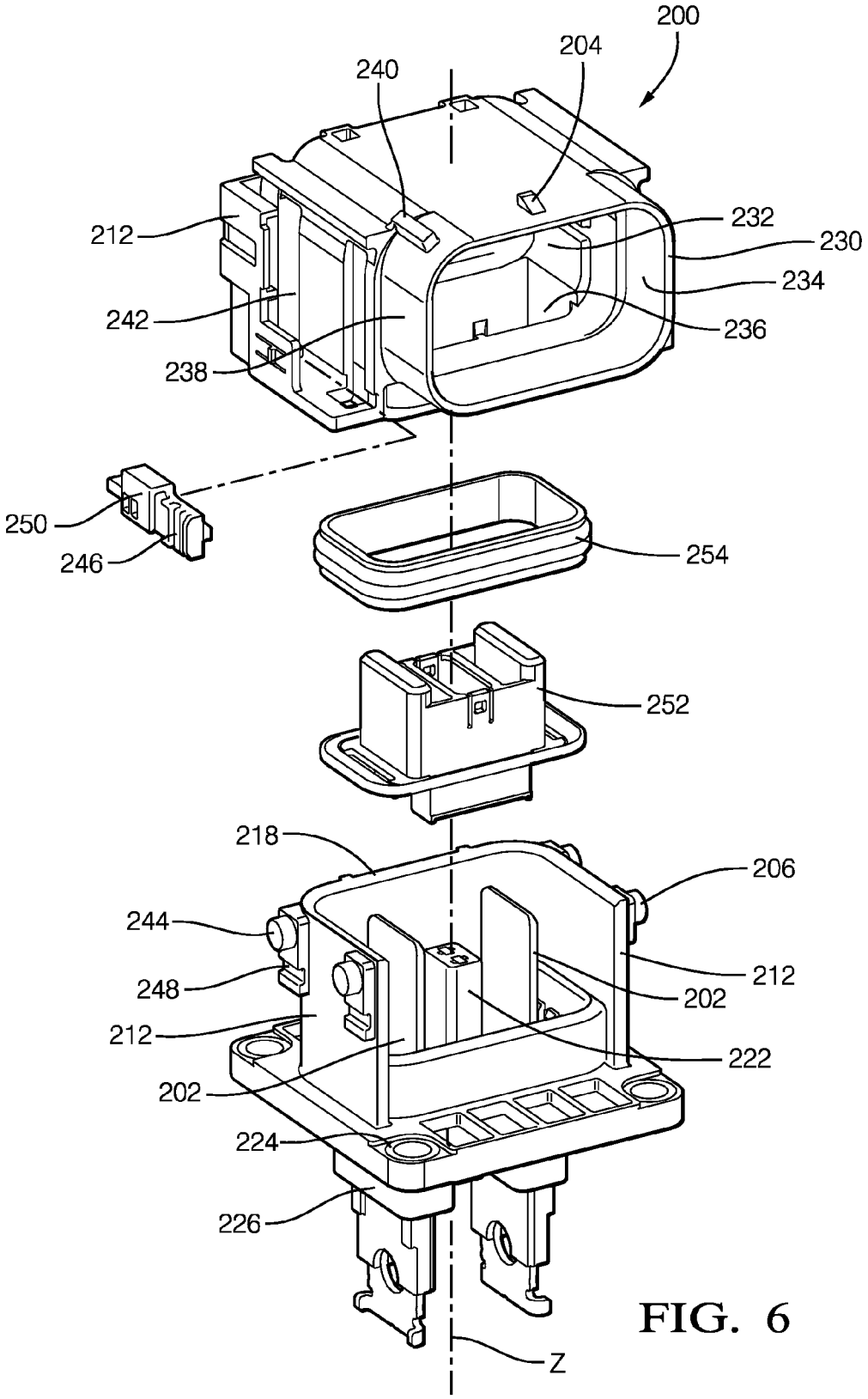
FIG. 6 is an exploded perspective view of a second connector of the electrical connector assembly of FIG. 1 according to one embodiment.

An exploded diagram of the second connector 200 is shown in FIG. 6. The second connector 200 is based around a second housing 216 to which the other components of the second connector 200 are attached. The second housing 216 is formed of a dielectric material such as PBT, PP, or NYLON. The second housing 216 defines a U-shaped shroud 218 around the male terminals 202. The side walls 220 of the shroud 218 define cam posts 206 that are received by the cam slots 152 after the first connector 100 is attached to the second connector 200. The second housing 216 also defines a tower 222 between the male terminals 202 configured to hold the HVIL terminals 214.

Figure 7:
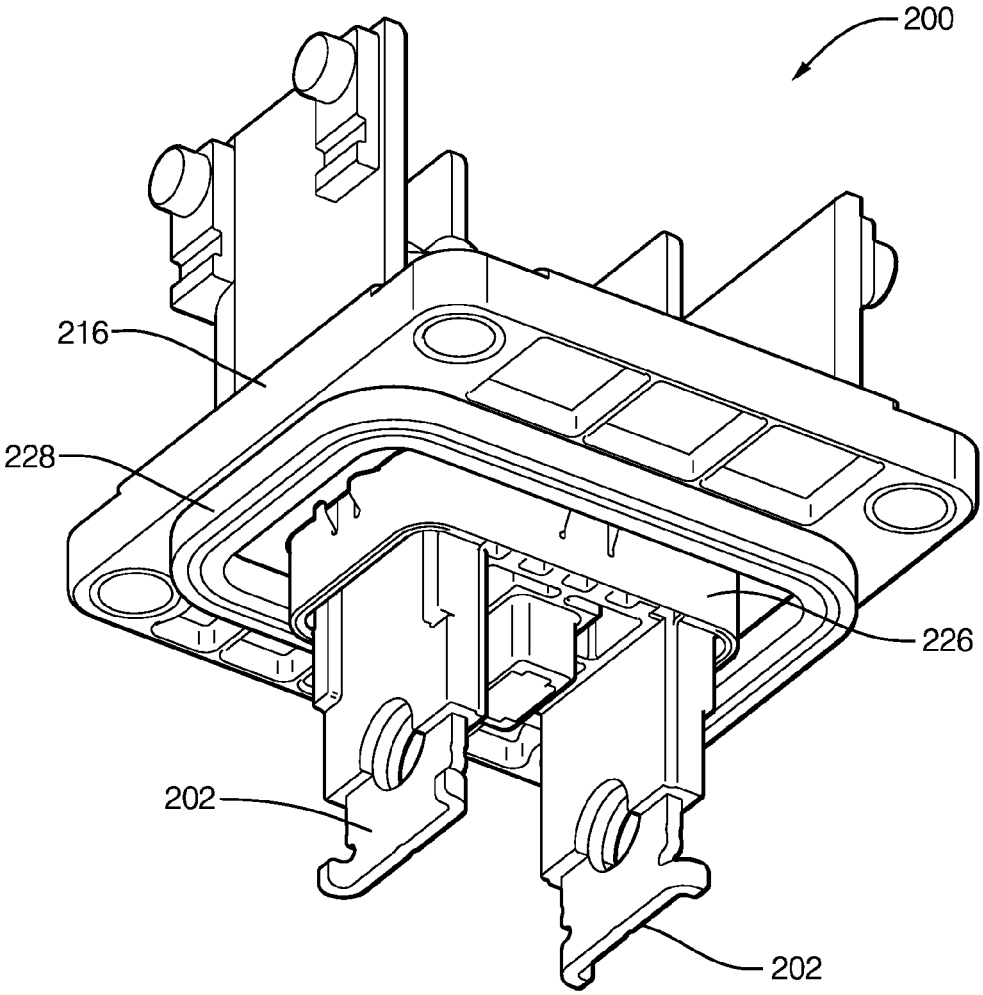
FIG. 7 is a bottom perspective view of the second connector of FIG. 6 according to one embodiment.

As shown in FIG. 7, the second housing 216 defines a flange having several openings that receive electrically conductive fasteners (not shown) to secure the second connector 200 to the conductive case of the battery pack (not shown). Conductive inserts 224 are received within the openings in the flange. The conductive inserts 224 are electrically connected to a conductive second grounding shield 226 that longitudinally surrounds the male terminals 202. The male terminals 202, the conductive inserts 224, and the conductors (not shown) that connect conductive inserts 224 to the second shield 226 may be insert molded within the second housing 216.

The second housing 216 further comprises a second seal 228. The second seal 228 is designed to seal the second connector 200 to the conductive case. The second seal 228 may be formed of a compliant material such as silicone rubber. The second seal 228 provides protection for the male terminals 202 from water, dust, and other environmental contaminants.

Returning again to FIG. 6, the second connector 200 also includes an intermediate housing 230 that is slideably attached to the second housing 216 and configured to slide along a second axis Z that is substantially perpendicular to the first axis X. As used herein, substantially perpendicular is ±5° of absolutely perpendicular, i.e. 90° between axes X and Z. The intermediate housing 230 defines a cavity 232 having a first intermediate opening 234 along the first axis X that is configured to receive the first connector 100 and a second intermediate opening 236 along the second axis Z that is configured to receive the second housing 216. The first intermediate opening 234 is surrounded by an intermediate shroud 238. The intermediate shroud 238 defines the primary locking nib 204 that engages the primary locking tab 136 of the first connector 100 to secure the first connector 100 to the second connector 200. The intermediate shroud 238 also defines a release ridge 240 that releases the slider latch 150 of the mating assist slider 140 so that it may be moved from its starting position 160.

The intermediate housing 230 slides relative to the second housing 216 from an initial position 208 to a final position 210 along longitudinal guide grooves 242 defined in each side wall of the intermediate housing 230 that receive longitudinal guide rails 244 defined by the side walls 220 of the shroud 218. Both the guide grooves 242 and the guide rails 244 are substantially parallel to the second axis Z. As used herein, substantially parallel is ±5° of absolutely parallel. The intermediate housing 230 is formed of a dielectric material such as PBT, PP, or NYLON.

The intermediate housing 230 is held in the initial position 208 by an intermediate locking bar 246 a locking bar that is retained and slideably attached to the intermediate housing 230 and is laterally slideable along the first axis X. The locking bar 246 holds the intermediate housing 230 in the initial position 208 by engaging a lateral locking groove 248 in the guide rails 244 on at least one side of the second housing 216 until the locking bar 246 is slid laterally aligning a notch 250 in the locking bar 246 with the guide rail 244, thereby disengaging the locking bar 246 from the locking groove 248 and allowing the intermediate housing 230 to slide from the initial position 208 to the final position 210.

The intermediate housing 230 includes a terminal cover 252 fixedly attached to the intermediate housing 230 within the second intermediate opening 236. The terminal cover 252 is configured to enclose the male terminals 202 when the intermediate housing 230 is in the initial position 208, thus preventing accidental contact by a finger of an assembly operator or a foreign conductive element, such as a screwdriver or wrench, with the male terminals 202 when the first connector 100 is not mated with the second connector 200. When the intermediate housing 230 is lowered to the final position 210, at least a portion of each of the male terminals 202 are exposed allowing contact and coupling with the female terminals 102 of the first connector 100. The terminal cover 252 also encloses the tower 222 of the second housing 216 and the HVIL terminals 214 within when the intermediate housing 230 is in the initial position 208, thus preventing accidental contact by a foreign conductive element with the HVIL terminals 214 that could short the HVIL terminals 214 together and inappropriately enable the HVIL circuit. When the intermediate housing 230 is lowered to the final position 210, the HVIL terminals 214 are exposed allowing contact with the HVIL shunt 170 of the first connector 100. The terminal cover 252 is formed of a dielectric material such as PBT, PP, or NYLON.

The intermediate housing 230 further comprises an intermediate seal 254. The intermediate seal 254 is designed to seal the intermediate housing 230 to the second housing 216. The intermediate seal 254 may be formed of a compliant material such as silicone rubber. The intermediate seal 254 provides protection for the male terminals 202 from water, dust, and other environmental contaminants.

The intermediate housing 230 also defines the secondary locking tab 212 that cooperates with the secondary locking nib 164 of the first connector 100 to inhibit movement of the mating assist slider 140 after the first and second connectors 100, 200 are fully mated.

The intermediate housing 230 also includes a conductive intermediate grounding shield 256. The intermediate shield 256 has a first intermediate shield 256A that longitudinally surrounds the female terminals 102 along the first axis X and a second intermediate shield 256B that longitudinally surrounds the male terminals 202 along the second axis Z. The first intermediate shield 256A defines a first shield opening along the first axis X that is coaxial with the first intermediate opening 234 and a second shield opening along the second axis Z that is coaxial with the second intermediate opening 236. The second intermediate shield 256B is received within the second shield opening of the first intermediate shield 256A.

When the first and second connectors 100, 200 are fully mated, the intermediate shield 256 is electrically connected to the first shield 124 within the first connector 100 and the second shield 226 within the second housing 216, thereby providing an electrical path for the grounding shields 124, 226, 256 of the first and second connectors 100, 200 and the shield conductors of the shielded wire cables 14 to the conductive case of the battery pack.

FIGS. 8 through 14 illustrate the process of mating the first connector 100 to the second connector 200.

Figure 8:
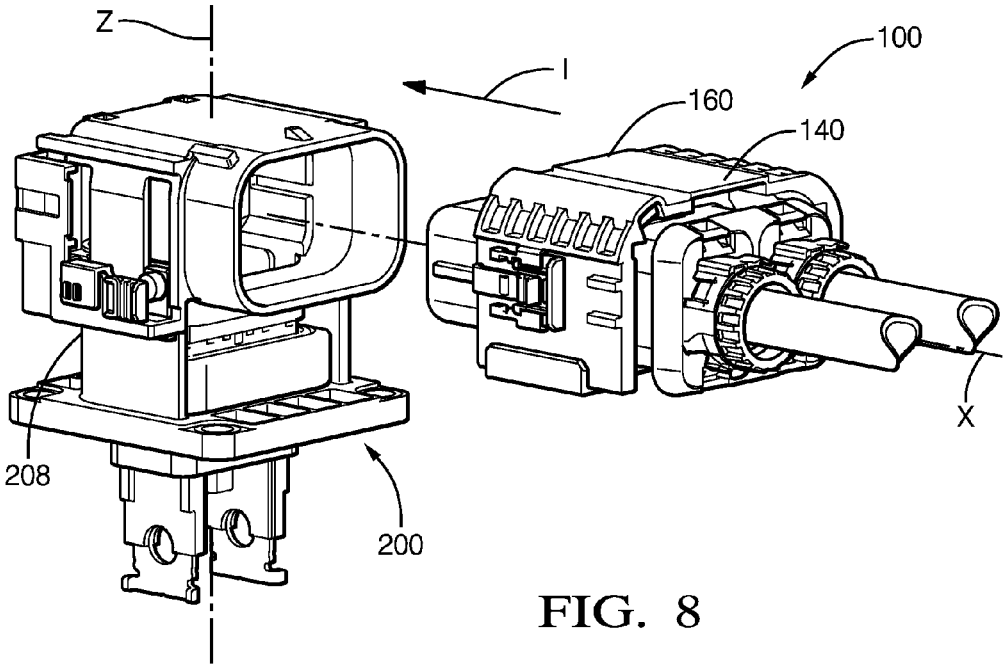
FIG. 8 is a perspective view of the first and second connectors of the electrical connector assembly of FIG. 1 in a pre-mated condition according to one embodiment.
Figure 9:
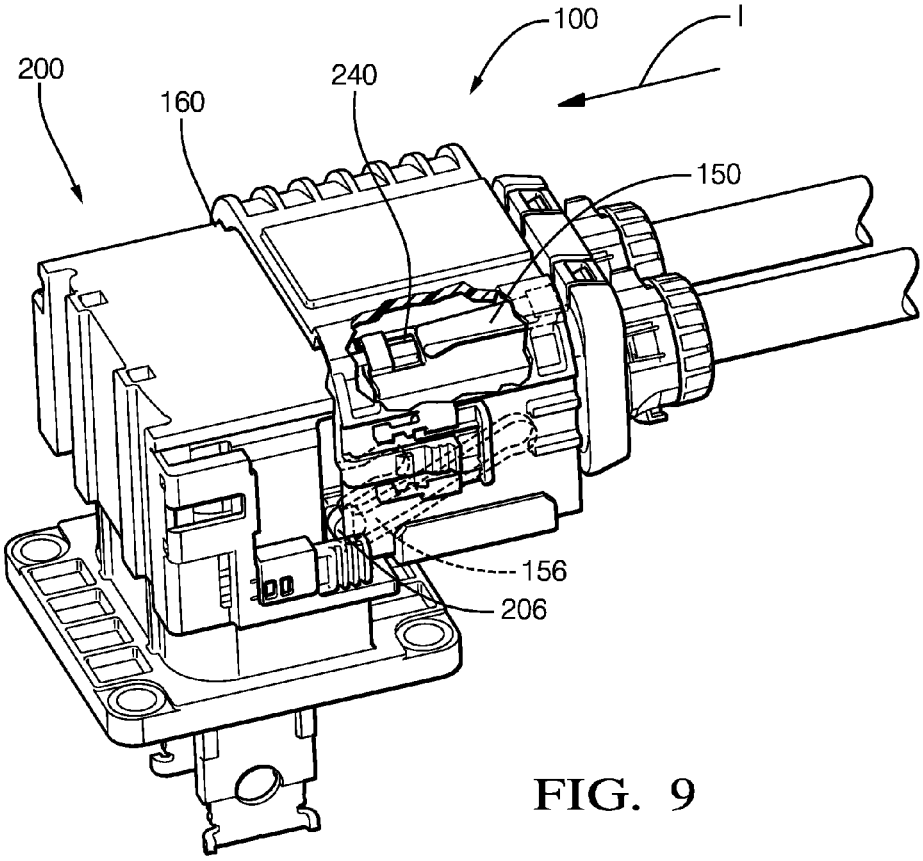
FIG. 9 is a cutaway side view of the first and second connectors of the electrical connector assembly of FIG. 1 in the pre-mated condition of FIG. 8 according to one embodiment.

FIG. 8 shows the first and second connectors 100, 200 in a pre-mated condition. The mating assist slider 140 is in the starting position 160 and the intermediate housing 230 is in the initial position 208. The terminal cover 252 is enclosing the male blade terminals 202 and the HVIL terminals 214.

FIG. 8 shows the first and second connectors 100, 200 in a partially mated condition wherein the first connector 100 is received within the first intermediate opening 234 along an insertion direction I parallel to the first axis X. The primary locking nib 204 defined by the intermediate shroud 238 of the second connector 200 has engaged the primary locking tab 136 of the first connector 100, thus securing the first connector 100 to the second connector 200. The release ridge 240 of the intermediate shroud 238 has pushed the slider latch 150 of the mating assist slider 140 up so that it is no longer engaged with the first housing 104 of the first connector 100 and be moved from its starting position 160. The cam post 206 has been received within the slot opening 156 of the cam slot 152.

Figure 10:
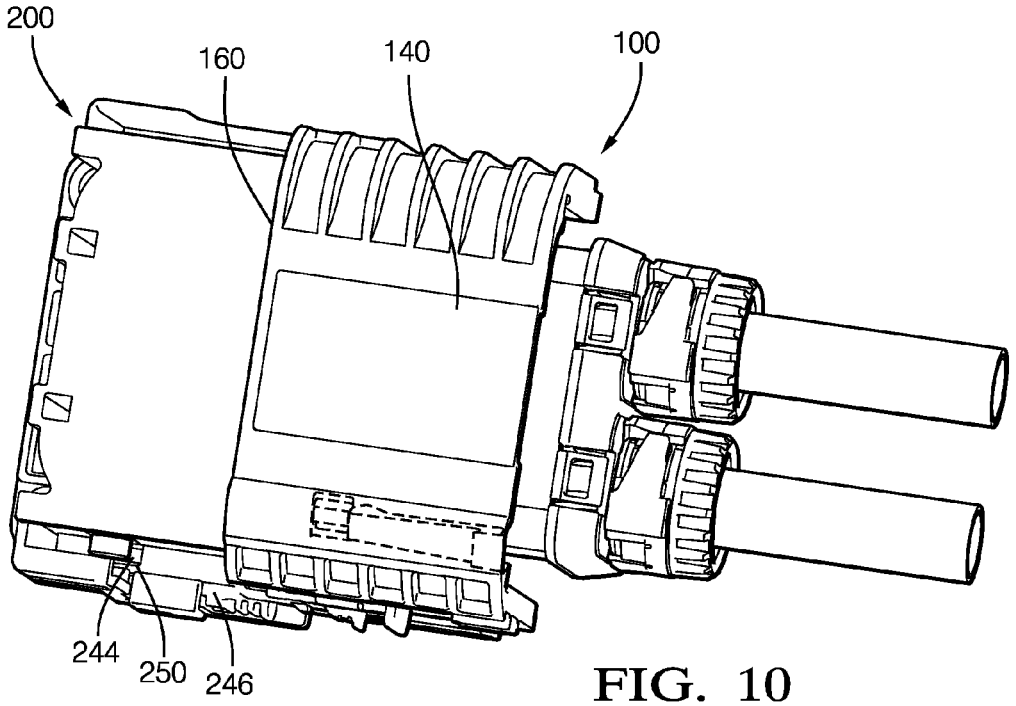
FIG. 10 is a cutaway top view of the first and second connectors of the electrical connector assembly of FIG. 1 in the pre-mated condition of FIG. 8 according to one embodiment.
Figure 11:
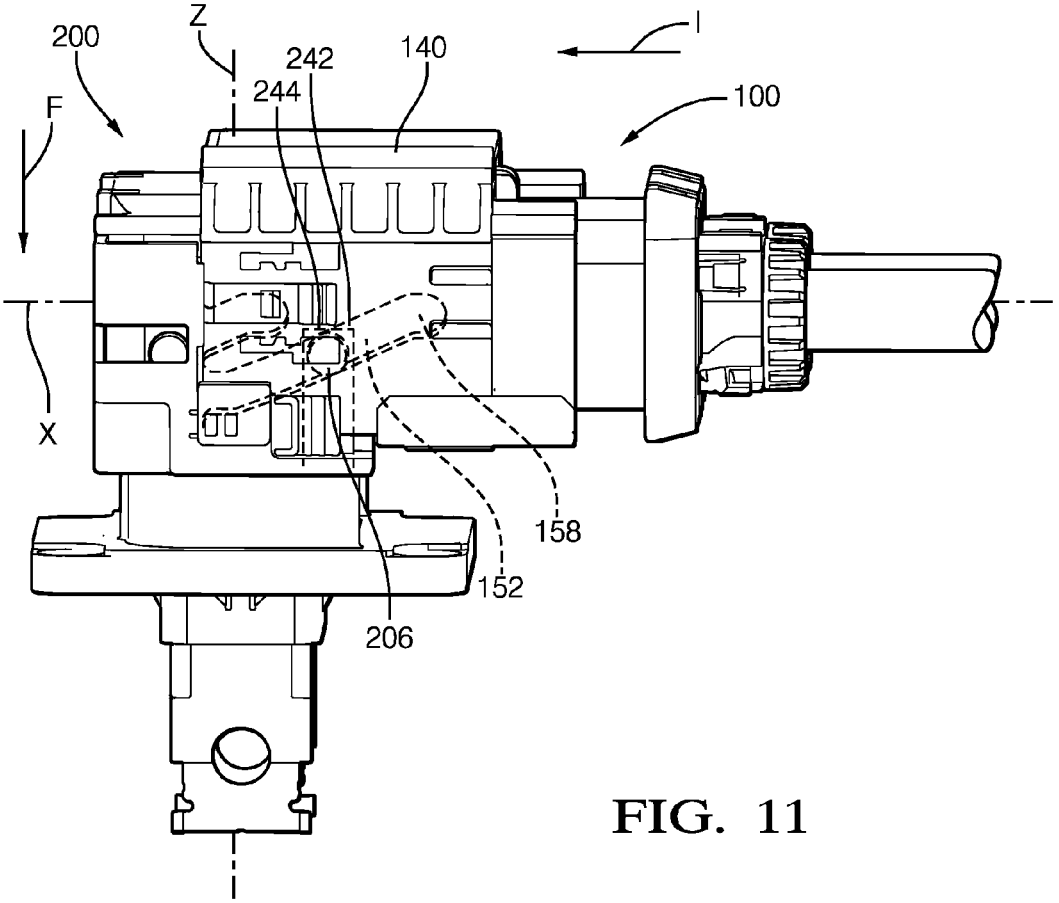
FIG. 11 is a cutaway side view of the first and second connectors of the electrical connector assembly of FIG. 1 in a partially mated condition according to one embodiment.

As shown in FIG. 10, the first and second connectors 100, 200 are still in the partially mated condition. The locking bar 246 has been slid forward, laterally aligning the notch 250 in the locking bar 246 with the guide rail 244, thereby disengaging the locking bar 246 from the locking groove 248 and allowing the intermediate housing 230 to slide from the initial position 208 to the final position 210. In this illustrated example, the locking bar 246 is configured to be slid forward manually by the assembly operator. In other embodiments of the connector assembly, the locking bar may be moved from the locking position by contact with a part of the first connector when it is inserted into the second connector.

As shown in FIG. 10, the first and second connectors 100, 200 are still in the partially mated condition, however the mating assist slider 140 has been moved along the first axis X to a position intermediate the starting position 160 and ending position 162. The cam post 206 is engaged with the ramp 154 of the cam slot 152 and is generating a mating force F parallel to the second axis Z, i.e. generally perpendicular to the first axis X, that has moved the intermediate housing 230 along the second axis Z from the initial position 208 toward the final position 210.

Figure 12:
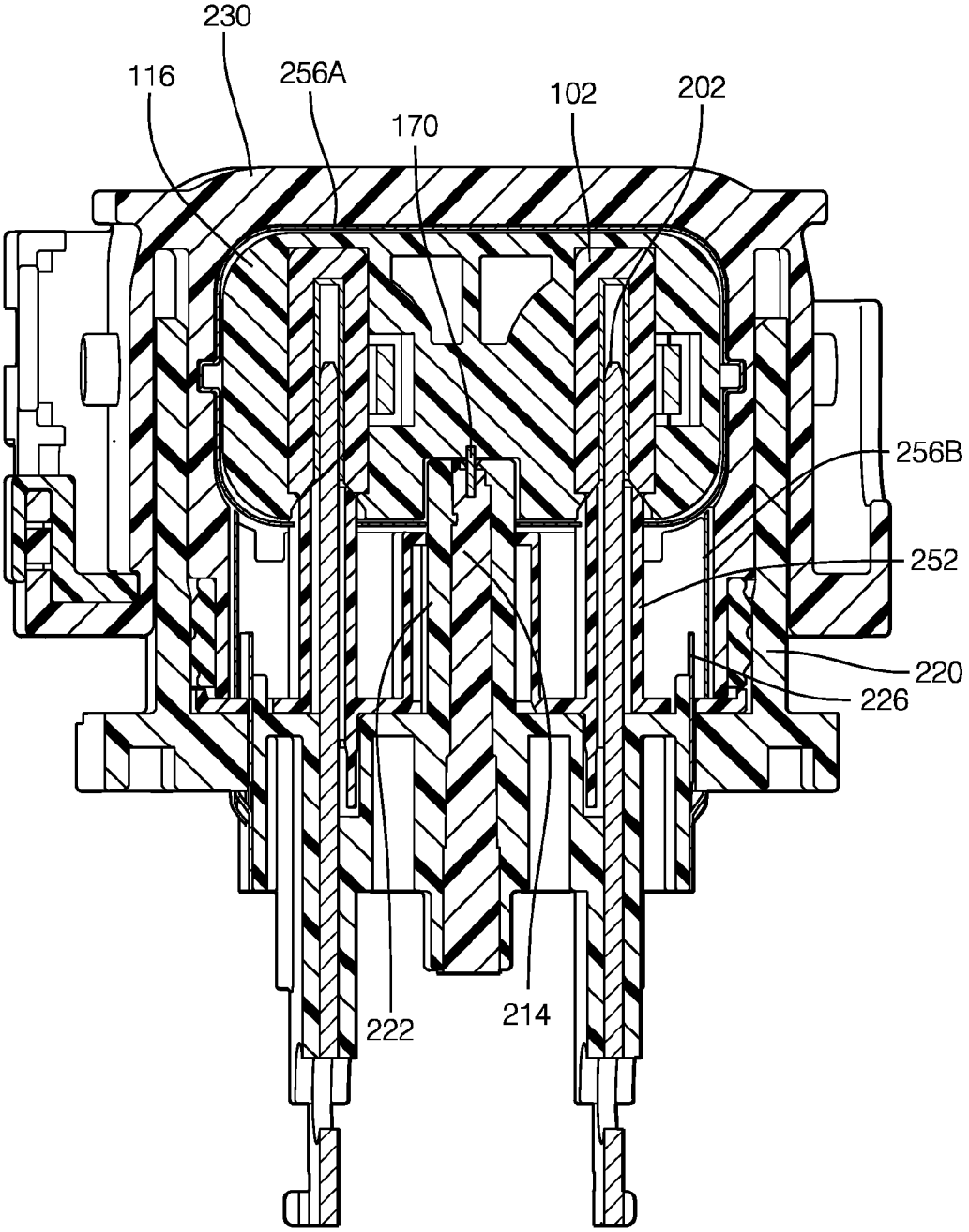
FIG. 12 is a cutaway side view of the first and second connectors of the electrical connector assembly of FIG. 1 in a fully mated condition according to one embodiment.

As shown in the cross section diagram of FIG. 12, the first and second connectors 100, 200 are in a fully mated condition. The terminal cover 252 has moved down to expose the male terminals 202 and the HVIL terminals 214. The male terminals 202 are fully mated within the first opening 108 of the female terminals 102 and the HVIL shunt 170 is inserted within the HVIL terminals 214.

As seen in FIG. 13, the first and second connectors 100, 200 are still in the fully mated condition. The intermediate housing 230 is in its final position 210. The mating assist slider 140 has been moved to the final position 210 and the secondary locking nib 164 of the mating assist slider 140 is engaged with the secondary locking tab 212 of the intermediate housing 230. In order to disengage the secondary locking nib 164 so that the mating assist slider 140 may be moved from the final position 210, an operator must depress the end of the secondary lock nib. The CPA device 166 is in a rearward position so that the tongue 168 of the CPA device 166 is not engaging the secondary locking nib 164.

As seen in FIG. 14, the first and second connector 100, 200 remain in the fully mated condition. The CPA device 166 is slid forward so that the tongue 168 of the CPA device 166 is wedged between the secondary lock nib and the outer side wall of the mating assist slider 140, thereby preventing the end of the secondary locking nib 164 from being depressed and inhibiting movement of the mating assist slider 140 from the final position 210.

Although the illustrated embodiment of the right angle connector assembly shown herein includes an HVIL shunt and HVIL connectors, other embodiments of the connector assembly may be envisioned without those elements in applications of the connector assembly where a high voltage interlock circuit is not required. Alternatively, other embodiments of the connector assembly may be envisioned without a terminal cover for use in applications of the connector assembly where finger intrusion protection is not required.

The examples presented herein are directed to electrical connector assemblies, however other embodiments of the connector assembly may be envisioned that are adapted for use with optical cables or hybrid connectors including both electrical and optical cable connections. Yet other embodiments of the connector system may be envisioned that are configured to interconnect pneumatic or hydraulic lines. The force generated by the mating assist slider 140 may beneficially provide a sealing force to seals interconnecting pneumatic or hydraulic lines.

Accordingly an electrical connector assembly is provided. The assembly allows insertion of the first connector 100 into the second connector 200 and activation of the mating assist lever along a single axis, reducing the packaging space required around the connector assembly and simplifying ergonomics for attaching the first and second connectors 100, 200 for assembly operators. The assembly also provides the benefit of covering the male terminals 202 and HVIL terminals 214 when the first connector 100 is not connected to the second connector 200, thus reducing the possibility of inadvertent contact of the male terminals 202 or HVIL terminals 214 by the hand of an operator or a conductive element, e.g. a tool.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector assembly, comprising:

a first connector having a first housing having a mating assist slider attached to the first housing and configured to slide along a first axis defined by the first connector; and a second connector having a second housing and an intermediate housing attached to the second housing and configured to slide along a second axis defined by the second connector, wherein the intermediate housing is configured to receive the first housing along the first axis, wherein the mating assist slider is configured to move the intermediate housing along the second axis from an initial position to a final position when the mating assist slider is moved along the first axis from a starting position to and ending position, and wherein the first axis is substantially perpendicular to the second axis.

2. An electrical connector assembly, comprising:

a first connector having a first housing containing a first electrical terminal and a mating assist slider attached to the first housing and configured to slide along a first axis defined by the first connector; and a second connector having a second housing containing a second electrical terminal and an intermediate housing attached to the second housing and configured to slide along a second axis defined by the second connector, wherein the intermediate housing is configured to receive the first housing along the first axis, wherein the mating assist slider is configured to move the intermediate housing along the second axis from an initial position to a final position when the mating assist slider is moved along the first axis from a starting position to and ending position, thereby mating the first electrical terminal to the second electrical terminal, and wherein the first axis is substantially perpendicular to the second axis.

3. The electrical connector assembly according to claim 2, further comprising a terminal cover attached to the intermediate housing and configured to enclose the second electrical terminal when the intermediate housing is in the initial position and at least partially expose the second electrical terminal when the intermediate housing is in the final position.

4. The electrical connector assembly according to claim 2, further comprising a locking bar slideably attached to the intermediate housing, wherein the second housing defines a locking groove, and wherein the locking bar is configured to secure the intermediate housing in the initial position to the final position when the locking bar is engaged with the locking groove and allow movement of the intermediate housing from the initial position to the final position when the locking bar is disengaged from the locking groove.

5. The electrical connector assembly according to claim 2, wherein the mating assist slider defines a channel having a top wall and two side walls.

6. The electrical connector assembly according to claim 5, wherein the second housing defines a cam post, wherein at least one of the two side walls of the mating assist slider defines a cam slot configured to receive the cam post of the second connector, and wherein upon moving the mating assist slider from the starting position to the ending position, the cam slot is moved relative to the cam post producing a force along the second axis which drives the intermediate housing from the initial position to the final position.

7. The electrical connector assembly according to claim 2, further comprising a connector position assurance device slideably attached to the mating assist slider and configured to inhibit movement of the mating assist slider from the ending position when engaged.

8. The electrical connector assembly according to claim 2, further comprising an intermediate/first housing seal configured to provide an environmental seal between the intermediate housing and the first housing when the first housing is mated with the intermediate housing.

9. The electrical connector assembly according to claim 2, further comprising an intermediate seal configured to provide an environmental seal between the intermediate housing and the second housing when the intermediate housing is in the final position.

10. The electrical connector assembly according to claim 2, wherein the first connector includes an interlock shunt and the second connector includes a pair of interlock terminals and wherein the interlock shunt is configured to electrically connect the pair of interlock terminals when the intermediate housing is in the final position.

11. The electrical connector assembly according to claim 10, further comprising a terminal cover attached to the intermediate housing and configured to enclose the pair of interlock terminals when the intermediate housing is in the initial position and expose the pair of interlock terminals when the intermediate housing is in the final position.

* * * * *